United States Patent [19]

Beal et al.

[11] Patent Number: 4,976,253

[45] Date of Patent: Dec. 11, 1990

[54] METHOD AND APPARATUS FOR BURNING GAS IN THE COMBUSTION CHAMBER OF A FIREPLACE

[75] Inventors: Thomas J. Beal, Ossian; Tadeusz Karabin, Huntington; Roy E. Mundy, Andrews, all of Ind.

[73] Assignee: Majco Building Specialties, L.P., Huntington, Ind.

[21] Appl. No.: 464,168

[22] Filed: Jan. 12, 1990

[51] Int. Cl.[5] ..... F24C 3/00

[52] U.S. Cl. ..... 126/512; 126/92 R; 431/125

[58] Field of Search ..... 126/512, 513, 500, 515, 126/92 R, 92 AC, 92 B, 503; 431/125, 110, 112, 328, 329; 40/428

[56] References Cited

U.S. PATENT DOCUMENTS

| | | | |
|---|---|---|---|
| 3,291,116 | 12/1966 | Brooks | 431/125 |
| 3,760,790 | 9/1973 | Voges et al. | 431/125 |
| 4,793,322 | 12/1988 | Shimek et al. | 126/512 |
| 4,838,240 | 6/1989 | Rieger | 126/512 |
| 4,883,043 | 11/1989 | Thow et al. | 126/512 |

*Primary Examiner*—James C. Yeung
*Attorney, Agent, or Firm*—Hoffmann & Baron

[57] ABSTRACT

Method and gas burner assembly for producing among the arrangement of non-combustible logs, and essentially yellow flame pattern with substantially low levels of carbon monoxide production. In general, method hereof employs a gas burner assembly having one or more burner each having a plurality of gas jets. The burner assembly is disposed between the combustion chamber of fireplace enclosure which contains a predetermined volume of combustion chamber air which is continuously provided from outside of the combustion chamber. Non-combustible fireplace logs are arranged above the gas burner assembly so as to provide one or more flow paths between the burner and adjacent logs, for allowing free flow of combustion chamber air through the flow paths and about the burners. Flow of gas is provided through the burners so that the gas flows out of the gas jets and mixes with the combustion chamber air about the jets of the burner. Combustion chamber air flowing through the flow paths and about the burner is concentrated so that the flame pattern has essentially a yellow color, and the logs above the burners are maintained at a sufficient temperature so that combustion gases flowing out of the fireplace exhaust have substantially low levels of carbon monoxide. In the preferred embodiment, an H-shaped burner is used in practicing the method of the present invention.

20 Claims, 4 Drawing Sheets

METHOD AND APPARATUS FOR BURNING GAS IN THE COMBUSTION CHAMBER OF A FIREPLACE

BACKGROUND OF THE INVENTION

1. Field of Invention

The present invention relates generally to a gas burner assembly, and more particularly to a method of burning gas in a gas burner assembly mounted in the combustion chamber of a fireplace, and which is capable of creating an essentially yellow flame pattern similar in appearance to yellow flames naturally formed in a real wood log fire, with acceptable levels of carbon monoxide production, while utilizing only gas and the air in the combustion chamber.

2. Description of Related Art

Gas burner assemblies for fireplaces are well known. However, to achieve substantially complete combustion of the gas fuel, "primary air" is introduced into the gas-air mixing chamber before it flows into the burner and out from its jets. "Secondary air", i.e., the air present in the combustion chamber, completes the combustion and the gas generally burns with a clear blue flame at a level below the yellow flame. To give the appearance of a log burning fireplace, the clear blue flame must be concealed from view by the artificial logs to provide the appearance of a yellow flame similar to the yellow flames formed in a real wood log fire.

Such a prior art method and fireplace gas burner assembly are disclosed in U.S. Pat. No. 4,838,240 to Rieger. However, such a fireplace gas burner assembly suffers from several significant shortcomings and drawbacks. In particular, this prior art burner assembly requires the use of artificial logs made from expensive ceramic fibre materials to reduce the formation of carbon monoxide gas during operation. Also, such prior art gas burner assembly requires "premixing" of gas and "primary air" using a venturi effect to form a desirable air and gas mixture in a fuel mixing chamber. In addition, such prior art gas burner assembly forms "blue flames" at a level below the yellow flames due to the introduction of additional fresh (i.e., "secondary") air into the combustible fuel mixture so that the fuel mixture can burn more cleanly and reduce production of carbon monoxide gas.

Accordingly, it is a primary object of the present invention to provide a method and fireplace gas burner assembly for producing an essentially yellow flame pattern having an appearance similar to the yellow flame that is produced by a natural wood log fire, and with virtually no carbon monoxide gas being produced and utilizing only the air available in the combustion chamber of the fireplace enclosure.

Another object of the present invention is to provide a multiple flame gas burner having means to provide an essentially yellow flame while maintaining complete combustion which substantially is free of carbon monoxide.

It is another object of the present invention to provide a method of producing a yellow flame pattern similar in appearance to the yellow flame pattern formed in a natural wood log fire, using only "secondary air" available in the combustion chamber of a fireplace enclosure, and an arrangement of non-combustible logs (and air/flame deflectors) to create a desirable pattern of air flow about the gas burner as well as maintenance of necessary flame temperatures, which together, facilitates production of an essentially yellow flame and acceptable carbon monoxide levels in accordance with ANSI Standards.

These and other objects of the present invention will become apparent hereinafter and in the claims.

SUMMARY OF THE INVENTION

The present invention is directed to a method and gas burner assembly for producing amongst an arrangement of noncombustible fireplace logs, an essentially yellow flame pattern with substantially low levels of carbon monoxide production.

In general, the method hereof employs a gas burner assembly having one or more burners each having a plurality of gas jets. The burner assembly is disposed within the combustion chamber of a fireplace enclosure provided with an exhaust and a transparent viewing window. The combustion chamber contains a predetermined volume of combustion chamber air (i.e "secondary air") which is continuously provided from the outside of the combustion chamber, through, for example, air inlets formed below the transparent viewing window. The non-combustible fireplace logs are arranged above the gas burner assembly so as to provide one or more flow paths between the burners and adjacent logs, for allowing free flow of combustion chamber air through the flow paths and about the burners. A flow of gas is provided through the burners so that the gas flows out of the gas jets and mixes with the combustion chamber air about the jets of the burner. The mixture of gas and combustion chamber air is then ignited, thereby combusting the mixture, producing a flame pattern about the burners, and producing combustion gases from the combusted mixture. The combustion chamber air flowing through the flow paths and about the burners, is concentrated so that the flame pattern has an essentially yellow color. The logs above the burners are maintained at a sufficient temperature so that the combustion gases react in the flame pattern in proximity with the logs, whereby the combustion gases flowing out of the exhaust have substantially low levels of carbon monoxide.

In the preferred embodiment, the burner assembly includes an H-shaped burner formed from two spaced apart tubular members which are closed at each end and connected by a transverse tubular member. Each tubular member is provided with a plurality of gas jets. The tubular members form a continuous gas flow passage which is connectable to a source of gas by way of a gas inlet assembly. Air/flame deflectors are mounted to the spaced-apart tubular members and are disposed in overlying relation to the plurality of gas jets so that air in the combustion chamber passes, in a concentrated manner, between the upper surface of the tubular member and flame. The air/flame deflectors facilitate mixing of concentrated combustion chamber air and gas passing through the gas jets, thereby maintaining clean combustion without the necessity of premixing air with the gas fuel at the gas inlet assembly.

Another aspect of the present invention contemplates providing a gas burning fireplace having a combustion chamber, into which the gas burner assembly of the present invention is installed below an arrangement of noncombustible fireplace logs, so as to produce an essentially yellow flame pattern thereagainst, with substantially a low level of carbon monoxide production.

BRIEF DESCRIPTION OF THE DRAWINGS

For a further understanding of the objects of the present invention, reference is made to the following detailed description of the preferred embodiment, which is to be taken in connection with the accompanying drawings, wherein.

DETAILED DESCRIPTION OF THE PREFERRED EMBODIMENT

Figures 1, 2:
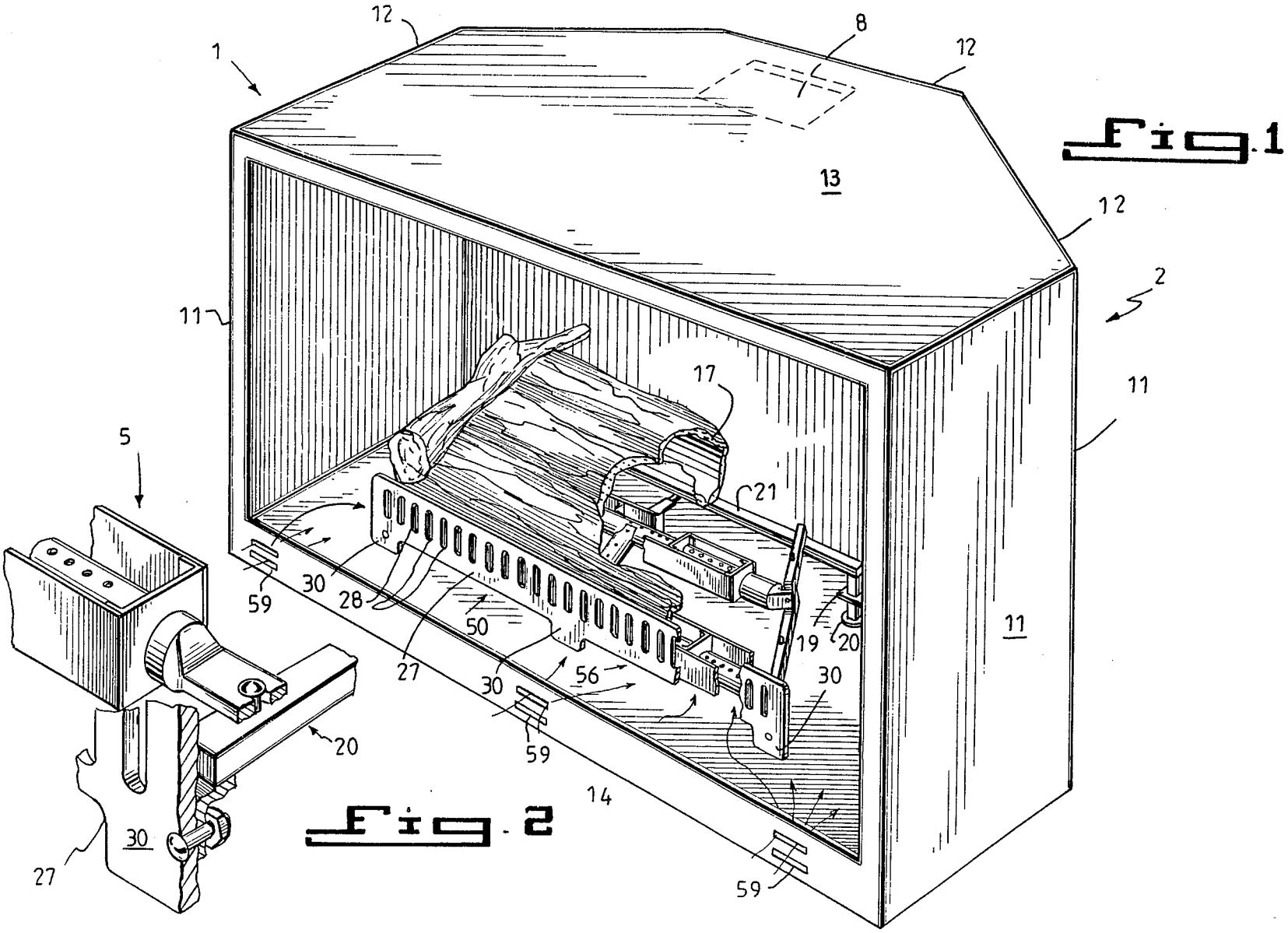
FIG. 1 is a perspective view of a combustion chamber of a fireplace enclosure in which the preferred embodiment of the gas burner assembly of the present invention is operably mounted on the hearth, with the grate assembly supporting an assembly of non-combustible fireplace logs shown partially broken away, with arrows indicating the direction of air flow within the combustion chamber of the fireplace enclosure.
FIG. 2 is an enlarged fragmentary view showing an end portion of one gas burner of the present invention mounted to the grate assembly.

In accordance with one of the broader aspects of the present invention, a method is provided for producing amongst a non-combustible fireplace log assembly, an essentially yellow flame pattern which is similar in appearance to the flame pattern formed by a natural burning log fire.

In accordance therewith, the method of the present invention achieves such a flame pattern by employing a gas burner assembly disposed within the combustion chamber of a fireplace enclosure, in which gas fuel mixes only with "secondary air" within the combustion chamber itself. This feature of the present invention is in marketed contrast with prior art fireplace gas burners which "pre-mix" gas and air in a gas-air mixer employing a venturi effect, and then passing this "pre-mixed" fuel-air mixture to the burner gas jets for ignition.

In carrying out the method of the present invention, it is necessary to create a desirable pattern of air flow in the combustion chamber of the fireplace enclosure, and establish and maintain flame temperatures required for combustion of gas with combustion chamber air at the flame site, to produce an essentially yellow flame pattern with acceptably low levels of carbon monoxide gas. It has been discovered that these functions, in conjunction with the gas burner, facilitate production of the essentially yellow flame pattern acceptable levels of carbon monoxide gas.

While it is expected to be possible to produce essentially yellow flame patterns and low carbon monoxide gas levels using a variety of configurations of gas burners operated in accordance with the principles of the present invention, the apparatus of the preferred embodiment employs a gas burner assembly having an H-shaped configuration. As will be discussed in detail hereinafter, there are several significant advantages in employing a burner assembly of such geometry.

Referring now to the drawings, a gas burning fireplace constructed in accordance with the principles of the present invention, will now be described in detail.

As shown in FIG. 1, the gas burning fireplace 1 in general, comprises a fireplace enclosure 2 having a combustion chamber 3 of a predetermined spatial extent and volume, and a grate assembly 4 supporting an H-shaped gas burner assembly 5. The grate assembly 4 also supports a noncombustible fireplace log assembly 6 formed from four individual logs. Taken together, the H-shaped gas burner assembly 5 and the grate assembly 4 are referred to hereinafter as the gas burner and grate assembly 7, and is clearly illustrated in FIGS. 3 and 4 in particular.

In general, the combustion chamber 3 of the fireplace enclosure includes side walls 11, rear walls 12, top wall 13 and a hearth (i.e. floor surface) 14. Top wall 13 is formed with an open outlet 8, shown in dotted line, which is connected to a chimney (not shown) for exhausting combustion gases. A glass panel assembly 60 is attached to the front opening of the fireplace enclosure 2, and provides a transparent window for viewing the logs and the essentially yellow flame pattern.

Figure 3:
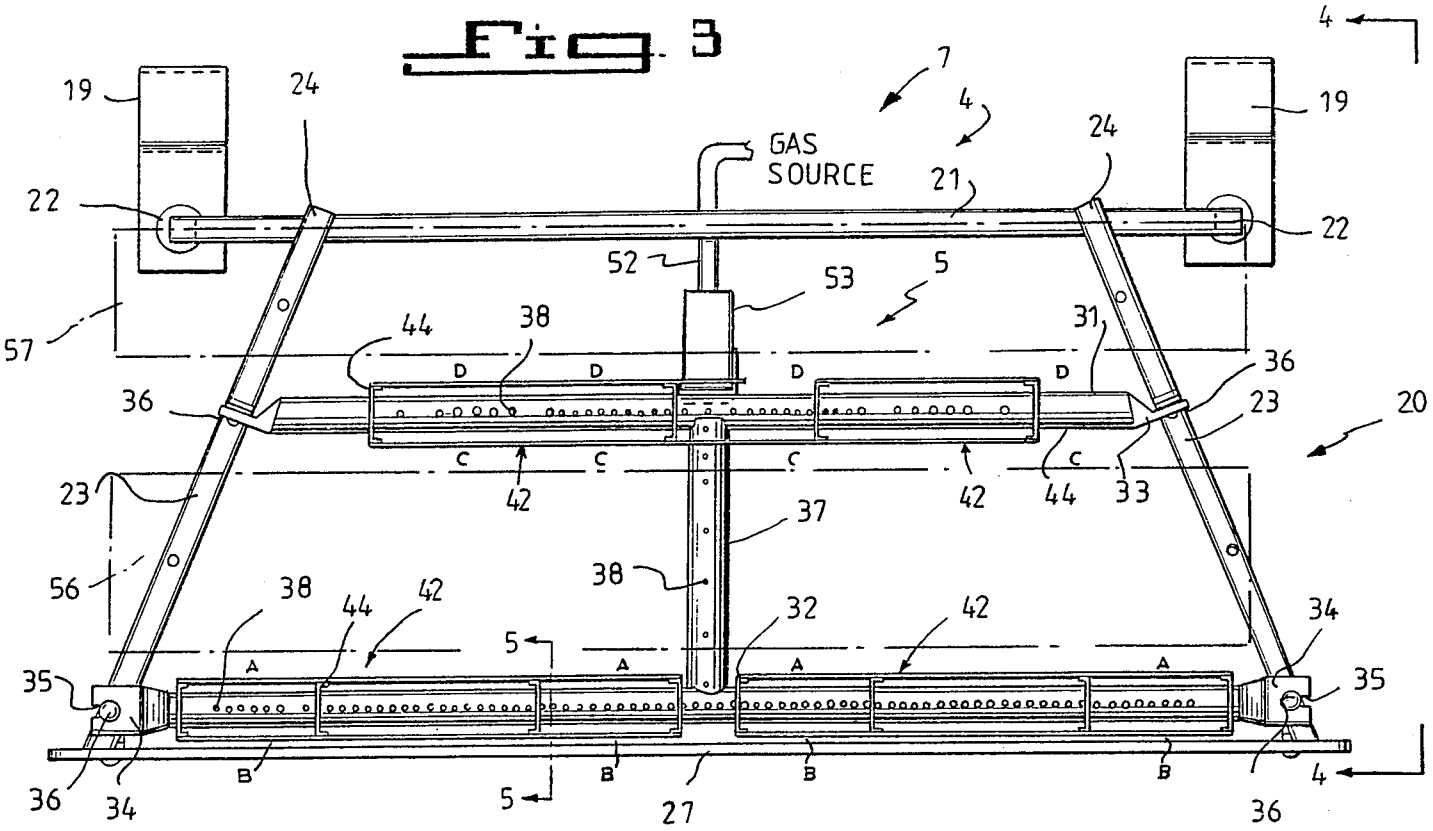
FIG. 3 is a top plan view of the burner assembly shown in FIG. 1, with the combustion chamber of the fireplace enclosure and the non-combustible fireplace logs removed.
Figure 4:
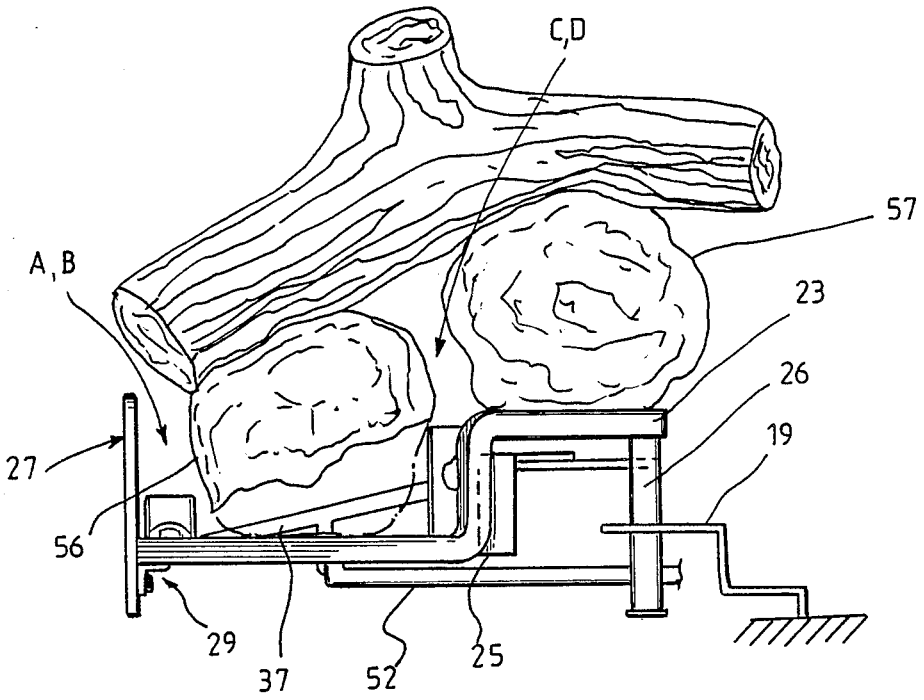
FIG. 4 is an elevational view taken along line 4—4 of FIG. 3.
Figure 5:
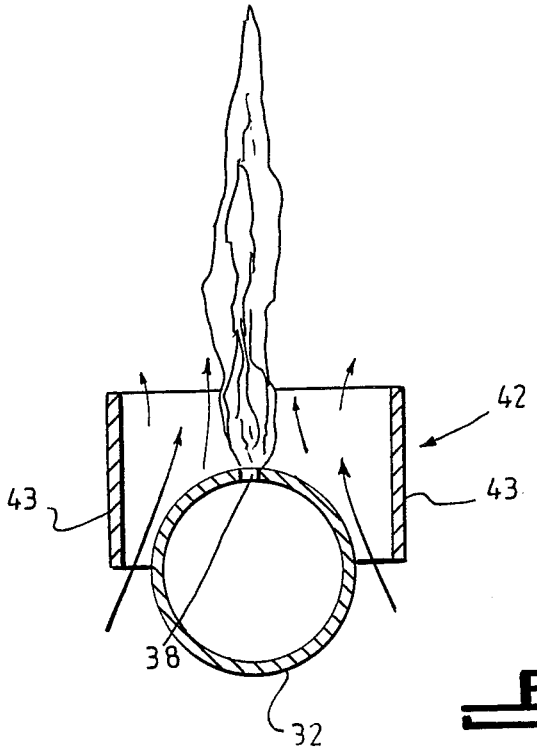
FIG. 5 is an elevational view in section taken along line 5—5 of FIG. 4, illustrating the air flow path between a air/flame deflector and a tubular member of the gas burner assembly, through which gas flowing out of the gas jet mixes with the air concentrated by the air/-flame deflector.

As shown in FIGS. 1, 3 and 5 in particular, grate assembly 4 includes a frame or grate 20, which is mounted on a hearth 14. The grate 20 includes a rear support member 21, each end 22 having an upright leg 26 which contacts hearth 14. An off-set anchor 19 is mounted on hearth 14 at one end and to up-right leg 26 at its other end, as shown in FIG. 4. A pair of side members 23 diverge slightly away from each other with inner ends 24 thereof positioned on top of rear support member 21, as shown in FIGS. 3 and 4. As shown in FIG. 4, an off-set 25 is formed between the ends of side members 23 to provide an upper portion and lower portion for supporting logs as will be described in greater detail hereinafter. Each side member 23 includes a part of the latch assembly which mounts the H-shaped gas burner assembly 5 onto the grate assembly 4, as shown in FIGS. 3 and 4.

As illustrated in FIGS. 1–3, a vertically disposed flat rectangular grate 27 having spaced apart vertical openings 28, is mounted to side members 23 at their outer ends by means of a weld. Legs 30, preferably three, are spaced along lower edge of the vertical grate 27, and provide two large air passageways 50 between the vertical grate member 27 and the hearth 14. As will be discussed in greater detail hereinafter, spaced apart-openings 28 and air passageways 50 facilitate a desirable pattern of air flow about the burner assembly 5.

As illustrated in FIG. 3, gas burner assembly 5 includes a pair of spaced apart tubular members 31 and 32 which are closed at their ends 33 and 34, respectively. Slots 35 are formed in closed ends 34, in which bolts, screws or rivets 36 secure tubular member 32 to the respective side member 23 of grate 20. As shown in FIG. 3, closed ends 33 of tubular member 31 are supported to side members 23, by either bolts, screws, rivets or other fastening means.

Tubular members 31 and 32 are interconnected by a transverse tubular member 37, preferably at their midpoint shown most clearly in FIG. 3, to form a gas flow path in an "H-shaped" configuration. Gas jets 38 are spaced along the upper surface of tubular members 31, 32, and 37. In general, gas jets 38 have varying diameters starting from the midpoint of tubular members 31 and 32 and moving toward their respective ends. Gas jets 38 along the transverse tubular member 37 are, however, symmetrically disposed thereabout and have the same diameter. Typical diameters of gas jets 38 range from about 0.040 to about 0.0935 of an inch and are spaced from each other from about 0.250 to about 0.750 of an inch. In order to feed gas through the jets 38, a gas inlet pipe 52 is connected to the midpoint of the transverse tubular member 37.

Applicants have discovered that use of an H-shaped burner in practicing the method of the present invention, provides several significant advantages. First, the H-shaped geometry of the burner facilitates equalizing gas pressure inside the tubular members through the entire burner assembly and thus provides "balance" (e.g. uniform flame pattern length) to the resulting flame pattern. Secondly, the H-shaped geometry facilitates acceptable flame propagation through the entire burner assembly 5. This is most important because ANSI Standards require stringent flame turn-on times, in order to avoid "flash" of burner. Thirdly, the H-shaped geometry of the burner assembly 5 provides a simple, yet highly effective way in which to provide multiple rows of flame patterns for realizing important aesthetic functions, without requiring multiple gas burner assemblies and a plurality of gas feed inlets.

Typically, gas fuel such as natural gas (i.e. methane) is introduced through the rear wall of the combustion chamber 3 and is coupled to the gas inlet pipe 52 to define a gas flow passage through the inlet pipe 52 and tubular members 31, 32 and 37. As shown in FIG. 3, an ignition means 53 is located in back of tubular member 31, and provides heat from pilot flame, or spark from a spark generator, to commence ignition of a flame which propagates towards the ends of tubular member 31 and along transverse member 37, eventually igniting gas flowing out of and mixing with primary air about tubular element 32. Preferably, the ignition means is a hot surface ignitor realized by silicon carbide crystal which is heated by passing an electrical current therethrough. Alternatively, however, instead of using the silicon-carbide ignitor, a continuous pilot flame, piezo-electric spark generator or functionally equivalent ignition means could be used to ignite the gas and combustion chamber air mixture.

As indicated in FIG. 4, the H-shaped burner assembly 5 is disposed at an angle with respect to the hearth 14 so that a front row of flames 54 and a back row flames 55 are provided, with the back row being higher than the front row of flames. To achieve such a flame pattern, tubular member 31 has some hole diameters which are larger than hole diameters of the tubular member 32; tubular member 31 is mounted to the upper portion of offset 25 of side members 23; whereas tubular member 32 is mounted adjacent the vertical openings 28 of rectangular grate member 27, so that transverse tubular member 37 is angularly disposed therebetween. It has been found when transverse tubular member 37 is inclined at about 12° towards tubular member 32, uniform flame density is achieved.

Figure 6:
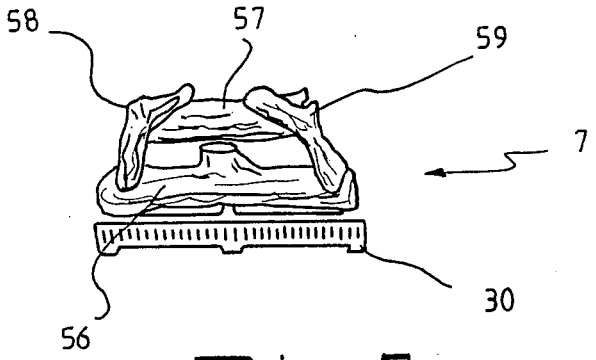
FIG. 6 is a perspective view of the gas burner and grate assembly hereof, supporting the fireplace log assembly of the preferred embodiment.
Figure 7:
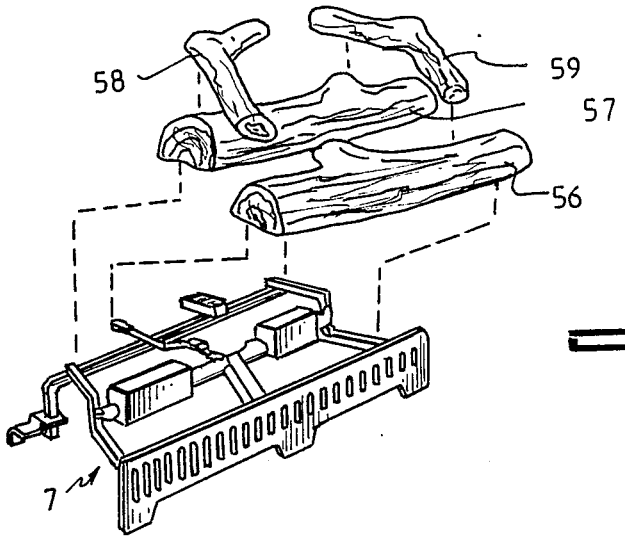
FIG. 7 is a perspective view of the gas burner and grate assembly hereof, showing an exploded view of the fireplace log assembly of the preferred embodiment.
Figure 8:
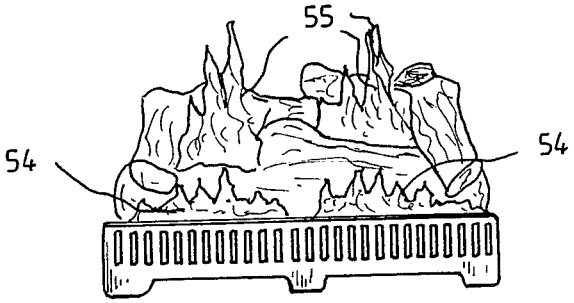
FIG. 8 is an elevated front view of the gas burner and grate assembly hereof, supporting the fireplace log assembly of the preferred embodiment, and showing the general geometrical characteristics of a typical flame pattern produced by the H-shaped gas burner assembly of the present invention.

In order to create a laminar flame flow and concentrate sufficient amounts of combustion chamber air flowing about the gas jets 38 and through the "flow paths" A, B, C and D, air/flame deflectors 42 are provided about the gas jets, as illustrated in FIGS. 1, 3, 4 and 5 in particular. As shown, each air/flame deflector 42 is formed having a pair of spaced vertically- disposed rectangular plates 43 and are mounted to a plurality of transversely spaced brackets 44 which straddle tubular member 31, 32. The lower end of each bracket 44 is mounted to tubular members 31, 32. As illustrated in FIGS. 4, 6 and 7, the fireplace log assembly 6 rests upon the grate assembly 4, and creates flow paths A, B, C, and D, which facilitate the flow of a desirable pattern of combustion chamber air about the burner 5. This air flow pattern in conjunction with the H-burner assembly hereof, facilitates production of a yellow flame pattern and acceptable levels of carbon monoxide. At the same time, the log assembly 6 functions to maintain log temperatures (e.g. above 300° F.) about the burner assembly, for combustion of gas with combustion chamber air to produce an essentially yellow flame pattern with acceptable levels of carbon monoxide production.

In the preferred embodiment, the log assembly 6 comprises a front log 56, a back log 57, a left log 58, and a right log 59. As shown in FIGS. 4 and 7 in particular, the front log 56 is supported on the lower portion of the side members 23 behind the tubular member 32. The general dimensions of the front log 56 and its spacing from the rectangular grate panel 27 is such that flow paths A and B are provided therebetween for the upward flow of combusted gases and heat away from the flame above the jets on tubular member 32. The back log 57 is supported on the upper portion of the side members 23 behind tubular member 31 and thus is elevated above the front log 56. The general dimensions of the back log 57 and its spacing from the front log 56 and the tubular member 32 is such that flow paths C and D are provided therebetween, also for the upward flow of combusted gases and heat away from the flame above the jets on tubular member 31. These logs are preferably made from a high temperature cement such as calcium aluminate, and maintain sufficiently warm, the space through which combustion gases flow about and above the burners, to facilitate further reduction of carbon monoxide.

Combustion chamber (i.e. secondary) air provided to the gas exiting the gas jets 38 along H-shaped burner assembly 5, is drawn from (i) the vertical slots in grate 27, (ii) air passageways 50 between the grate 30 and hearth 14, and (iii) from about the sides of the gas burner assembly as indicated by the arrows in FIG. 1 and 3, in particular. The source of this combustion chamber air within the combustion chamber 3 is provided from outside the fireplace enclosure 2 itself and is drawn through vent openings 59 typically provided beneath the glass panel assembly 60, which otherwise closes off the front panel of the combustion chamber.

The operation of the gas burning fireplace hereof, will now be described below.

In operation, gas inlet tube 52 is shifted from its closed inoperative position to its open operative position. Since the gas inlet tube 52 is directly mounted to the transverse tubular member 38, combustion chamber air does not mix with the gas fuel prior to its ejection through gas jets 38. Rather, combustion chamber air mixes only with the gas fuel flowing out of the gas jets 38 as shown by the direction of the arrows in FIGS. 1 and 5. As the gas fuel enters the gas flow passage at the junction of transverse member 37, the fuel flows outwardly to the ends of tubular member 31 and simultaneously forward through transverse tubular member 37 and finally outwardly to the ends of tubular member 32. As explained above, combustion chamber air mixes with this gas fuel, and is ignited by the ignition means 53, either electrically or manually. The flame propagation starts at the junction of transverse tubular member 37 and tubular member 31, propagates outwardly toward their respective ends, and then outwardly along tubular member 32. When all gas jets 38 are burning the flame density is substantially uniform, and burns with an essentially yellow flame and its products of combustion are substantially free of air, i.e., free oxygen and substantially free of carbon monoxide. In accordance with the present invention, there is no necessity to use ceramic coatings to reduce carbon monoxide production to acceptable ANSI Standard levels. When the flame passes through the flow paths of and between the fireplace logs, an appearance of natural burning logs is achieved.

One of the advantages of the method and apparatus of the present invention is to provide a gas burning fireplace having a burner assembly having very clean burning characteristics. For example, in the fireplace unit of the preferred embodiment, the carbon monoxide levels in the range of 6–20 ppm are achievable, and thus are well within ANSI Standards. These clean burning characteristics of the burner assembly may not be erroneously altered by the user since, in the fireplace unit hereof, the gas orifice is preset; the amount of gas supplied to the burner assembly cannot be changed; and the gas and air flow characteristics of the burner assembly and the air flow and thermodynamic characteristics of the fireplace log assembly, are all preset at the factory and thus remain essentially constant during operation.

While the particular embodiment shown and described above has been proven to be useful in the various applications in gas burning fireplace art, further modifications of the present invention herein disclosed will occur to those skilled in the art to which the present invention pertains, and all such modifications are deemed to be within the scope and spirit of the present invention defined by the following claims.

What is claimed is:

1. A method of producing an essentially yellow flame pattern amongst an arrangement of non-combustible fireplace logs, with a substantially low level of carbon monoxide production, said method using a gas burner assembly including a pair of spaced apart, elongate horzontal tubular members connected by a transversely extending third tubular member, each of said tubular members including a plurality of openings defining gas jets, and each of said horizontal tubular members including closed ends, said burner assembly being disposed within a combustion chamber of a fireplace enclosure provided with an exhaust and containing combustion chamber air which is continuously provided thereto from the outside of said combustion chamber, one of said pair of horizontal tubular members being positioned rearwardly of the other said horizontal tubular members, said method comprising:

(a) arranging said non-combustible fireplace logs above and adjacent to said gas burner assembly so as to provide one of more flow paths between said horizontal tubular members and adjacent logs, for the free flow of combustion chamber air through said flow paths and about said horizontal tubular members;

(b) providing a flow of gas through said tubular members so that said gas flows out of the gas jets and mixes with said combustion chamber air about said jets of said tubular members;

(c) igniting said mixture of gas combustion chamber air to thereby combust said mixture, producing a substantially uniform flame pattern along the lengths of said horizontal tubular members and producing combustion gases from said combusted mixture;

(d) concentrating combustion chamber air flowing through said flow paths and about said horizontal tubular members so that said flame patterns have an essentially yellow color; and (e) maintaining said logs above said tubular members at a sufficient temperature so that said combustion gases within said flame patterns react in said flame patterns in proximity with said logs, whereby said combustion gases flowing out of said exhaust have substantially low levels of carbon monoxide.

2. The method in accordance with claim 1, wherein step (a) comprises using fireplace logs made from calcium aluminate.

3. The gas burning fireplace of claim 1 wherein said third tubular member is connected substantially at the respective midpoints of said horizontal, tubular members, and wherein said flow of gas is introduced into said gas burner assembly via said third tubular member.

4. A gas burner assembly for use in the combustion chamber of a fireplace, comprising:

(a) a pair of spaced apart horizontal tubular members, each being closed at the ends thereof, and formed having a plurality of spaced apart openings along their upper surface to define a first plurality of gas jets;

(b) a transverse tubular member mounted to between the ends of said spaced apart tubular members to form a continuous gas flow passage therebetween, said transverse member having a plurality of spaced apart openings along its upper surface to define a second plurality of gas jets;

(c) a gas inlet means connected to said transverse tubular member and communicating with said gas flow passage; and (d) air/flame deflector means mounted to said horizontal tubular members in spaced overlying relations to said plurality of gas jets so that air in said combustion chamber flowing between the upper surface of said tubular members and said air/flame deflector is concentrated and mixed with gas passing through said gas jets.

5. The burner assembly according to claim 4, wherein a mounting means is mounted to at least one end of each longitudinal member.

6. The burner assembly according to claim 4 wherein said transverse tubular member is angularly positioned with respect to said spaced apart tubular members.

7. The burner assembly according to claim 6, wherein said transverse tubular member is inclined at an angle of about 12°.

8. The burner assembly according to claim 4, wherein said gas jets are symmetrically disposed about said transverse tubular members and constant in diameter, and increasing in diameter toward and respective ends of said horizontal tubular members.

9. The burner assembly according to claim 8, wherein said gas jets vary in diameter from about 0.040 to about 0.0935 of an inch.

10. The burner assembly according to claim 4, wherein said gas jets are disposed symmetrically about said transverse tubular member and are spaced a distance from each other from about 0.250 to about 0.750 of an inch.

11. A gas burning fireplace for producing an essentially yellow flame pattern with substantially low levers of carbon monoxide, said fireplace comprising:

(a) a fireplace enclosure including a combustion chamber having an exhaust, one or more ports for drawing in air from outside of said combustion chamber, and having at least one visible passageway for observing a flame pattern produced in said combustion chamber;

(b) a gas burner assembly disposed within said combustion chamber, said gas burner assembly including a pair of spaced apart, horizontal, elongate tubular members, and a third, transversely extending tubular member connecting said horizontal tubular members and providing a gas flow passage therebetween, each of said tubular members including a plurality of spaced apart openings along their respective upper surfaces, said openings defining a plurality of gas jets;

(c) a non-combustible log arrangement disposed above and adjacent to said gas burner assembly and arranged so as to provide one or more flow paths between said tubular members and adjacent logs, for allowing the free flow of combusted chamber air through said flow paths; and (d) ignition means for igniting a mixture of gas and combustion chamber air about said tubular members.

12. The gas burning fireplace of claim 11 including:

gas inlet means connected to said third tubular member and communicating with a gas flow passage therein; and air/flame deflector means adjoining said horizontal tubular members so that air in said combustion chamber may flow between the upper surface of said tubular members and said air/flame deflector means.

13. The gas burning fireplace of claim 12, wherein said third tubular member is angularly positioned with respect to said horizontal tubular members.

14. The gas burning fireplace of claim 13, wherein said third tubular member is inclined at an angle of about 12°.

15. The gas burning fireplace of claim 14, wherein said gas jets are symmetrically disposed about said transverse tubular member.

16. The gas burning fireplace of claim 11 wherein each of said horizontal tubular members includes a pair of closed ends.

17. The gas burning fireplace of claim 16 wherein one of said pair of horizontal, tubular members is nearer the rear of said combustion chamber than the other of said pair of horizontal, tubular members.

18. The gas burning fireplace of claim 17 wherein said one of said pair of horizontal, tubular members includes a plurality of openings which are larger than the openings in the other of said pair of horizontal, tubular members, whereby the flames produced by said one of said pair of horizontal, tubular members are higher than the flames produced by the other of said pair of horizontal, tubular members.

19. The gas burning fireplace of claim 11 wherein said tubular members define a substantially H-shaped gas burner assembly.

20. A gas burning fireplace comprising:

(a) a combustion chamber having mounted therein a gas burner assembly, said gas burner assembly including a pair of spaced apart horizontal tubular members, closed at each end thereof, and having a plurality of spaced apart openings along their respective upper surfaces to define a first plurality of gas jets;

(b) a transverse tubular member mounted between the ends of said spaced apart tubular members to form a continuous gas flow passage therebetween, said transverse member having a plurality of spaced apart openings along its upper surface to define a second plurality of gas jets;

(c) gas inlet means mounted to said transverse member and communicating with said continuous gas flow passage; and (d) air/flame deflecting means adjoining said horizontal tubular members so that air in said combustion chamber is capable of passing between the upper surface of said tubular members and said air/lame deflecting means to mix with gas passing through said plurality of gas jets, thereby maintaining combustion without premixing air at said gas inlet means.

* * * * *

UNITED STATES PATENT AND TRADEMARK OFFICE

CERTIFICATE OF CORRECTION

PATENT NO. : 4,976,253

DATED : December 11, 1990

INVENTOR(S) : Beal et al.

It is certified that error appears in the above-identified patent and that said Letters Patent is hereby corrected as shown below:

Claim 4, col. 8, line 43, after "mounted", delete "to"
line 54-55, change "relations" to --relation--

Claim 8, col. 9, line 4, after "toward", change "and" to --the--

Claim 11, col. 9, line 16, change "levers" to --levels--

Claim 20, col. 10, line 48, change "air/lame" to --air/flame--

Signed and Sealed this

Twelfth Day of May, 1992

*Attest:*

DOUGLAS B. COMER

*Attesting Officer*

*Acting Commissioner of Patents and Trademarks*